US010676162B2

(12) United States Patent
Roth et al.

(10) Patent No.: US 10,676,162 B2
(45) Date of Patent: Jun. 9, 2020

(54) AUTONOMOUS ANCHOR DEVICE AND METHODS USING DEPLOYABLE BLADES

(71) Applicant: The United States of America as represented by the Secretary of the Navy, San Diego, CA (US)

(72) Inventors: Leif Roth, San Diego, CA (US); Josh Bianchi, San Diego, CA (US); Adam White, San Diego, CA (US); Brian Daniel Shook, San Diego, CA (US)

(73) Assignee: United States Government as represented by the Secretary of the Navy, Washington, DC (US)

( * ) Notice: Subject to any disclaimer, the term of this patent is extended or adjusted under 35 U.S.C. 154(b) by 38 days.

(21) Appl. No.: 16/149,230

(22) Filed: Oct. 2, 2018

(65) Prior Publication Data

US 2020/0102054 A1 Apr. 2, 2020

(51) Int. Cl.
*B63B 21/26* (2006.01)
*B63B 21/38* (2006.01)

(52) U.S. Cl.
CPC ..... *B63B 21/26* (2013.01); *B63B 21/38* (2013.01); *B63B 2021/265* (2013.01)

(58) Field of Classification Search
CPC . B63B 2021/265; B63B 21/24; B63B 21/243; B63B 21/26; B63B 21/29
See application file for complete search history.

(56) References Cited

U.S. PATENT DOCUMENTS

| | | | |
|---|---|---|---|
| 5,988,948 | A | 11/1999 | Featherstone |
| 6,659,689 | B1 | 12/2003 | Courtney et al. |
| 7,310,287 | B2 | 12/2007 | Ray et al. |
| 7,602,667 | B2 | 10/2009 | Thompson |
| 7,984,684 | B2 | 7/2011 | Hinderks |
| 8,102,071 | B2 | 1/2012 | Catlin |
| 8,668,406 | B2 | 3/2014 | Vidal et al. |
| 8,740,543 | B2 | 6/2014 | Weaver |
| 8,964,298 | B2 | 2/2015 | Haddick et al. |
| 9,242,523 | B2 | 1/2016 | Teppig, Jr. et al. |
| 9,506,451 | B2 | 11/2016 | Dehlsen |
| 9,518,443 | B2 | 12/2016 | Tunget |
| 9,797,240 | B2 | 10/2017 | Tunget |
| 9,890,618 | B1 | 2/2018 | Goodman et al. |
| 10,040,549 | B2 | 8/2018 | Sarigul-Klijn et al. |
| 2003/0026662 | A1 | 2/2003 | Vidal et al. |
| 2004/0056779 | A1 | 3/2004 | Rast |
| 2004/0120774 | A1 | 6/2004 | Courtney et al. |
| 2004/0229531 | A1* | 11/2004 | Driscoll ..... B63B 21/243 441/23 |
| 2005/0052951 | A1 | 3/2005 | Ray et al. |
| 2007/0070808 | A1 | 3/2007 | Ray et al. |

(Continued)

OTHER PUBLICATIONS

Merle, Robert "The Day of the Dolphin", Avco Embassy Pictures, 1973, (wikipedia description attached) (Year: 1973).*

*Primary Examiner* — Andrew Polay
(74) *Attorney, Agent, or Firm* — Naval Information Warfare Center Pacific; Kyle Eppele; J. Eric Anderson

(57) ABSTRACT

An autonomous anchor device, involving a streamlined body configured to freefall through a water column and to drive itself into sediment of an aquatic environment and a plurality of blades operably coupled with the streamlined body and configured to deploy itself into the sediment as well as retract itself from the sediment.

2 Claims, 2 Drawing Sheets

(56) References Cited

U.S. PATENT DOCUMENTS

| | | | | |
|---|---|---|---|---|
| 2008/0106977 | A1 | 5/2008 | Ray et al. | |
| 2008/0137485 | A1 | 6/2008 | Ray et al. | |
| 2008/0141921 | A1 | 6/2008 | Hinderks | |
| 2008/0141922 | A1* | 6/2008 | Muehlner | B63B 21/243 114/294 |
| 2008/0238119 | A1 | 10/2008 | Rasmussen | |
| 2009/0230686 | A1 | 9/2009 | Catlin | |
| 2010/0219660 | A1 | 9/2010 | Rasmussen | |
| 2010/0329076 | A1 | 12/2010 | Ray et al. | |
| 2011/0200425 | A1 | 8/2011 | Weaver | |
| 2012/0192779 | A1 | 8/2012 | Teppig, Jr. et al. | |
| 2012/0227389 | A1 | 9/2012 | Hinderks | |
| 2013/0127980 | A1 | 5/2013 | Haddick et al. | |
| 2013/0278631 | A1 | 10/2013 | Border et al. | |
| 2014/0163664 | A1 | 6/2014 | Goldsmith | |
| 2014/0311741 | A1 | 10/2014 | Tunget | |
| 2015/0034311 | A1 | 2/2015 | Tunget | |
| 2015/0260095 | A1 | 9/2015 | Hinderks | |
| 2015/0260148 | A1 | 9/2015 | Dehlsen | |
| 2015/0274261 | A1* | 10/2015 | Bauer | B63B 21/26 701/21 |
| 2016/0101832 | A1 | 4/2016 | Teppig, Jr. et al. | |
| 2017/0144731 | A1* | 5/2017 | De Carvalho E Silva | B63B 21/26 |
| 2017/0327129 | A1 | 11/2017 | Cylvick | |
| 2018/0119669 | A1 | 5/2018 | Dehlsen | |

* cited by examiner

AUTONOMOUS ANCHOR DEVICE AND METHODS USING DEPLOYABLE BLADES

FEDERALLY-SPONSORED RESEARCH AND DEVELOPMENT

The United States Government has ownership rights in the subject matter of this invention. Licensing inquiries may be directed to Office of Research and Technical Applications, Space and Naval Warfare Systems Center, Pacific, Code 72120, San Diego, Calif., 92152; telephone (619) 553-5118; email: ssc_pac_t2@navy.mil. Reference Navy Case No. 103,786.

BACKGROUND OF THE INVENTION

Technical Field

The present disclosure relates to technologies for anchoring. Particularly, the present disclosure relates to technologies for improving anchoring strength.

Description of the Related Art

In the related art, traditional methods of anchoring to a sea floor require outside forces to set an anchor. For example, a line is pulled at a sharp angle to the sea floor, such that the anchor deeply plows into sediment of the sea floor. Other related art methods of so-called "self-anchoring" typically involve moving the anchor with a sufficiently high momentum, wherein the anchor tears through the sea floor until the anchor is driven into the sea floor. While this "self-anchoring" anchoring method does not require an outside force, this "self-anchoring" has limited anchoring strength. Yet other related art methods of anchoring involve autonomous embedment techniques, wherein pumps or shakers bury themselves into the sea floor. However, these related art autonomous embedment techniques consume inordinate energy and do not function well in muddy sea floors.

Thus, a need exists in the related art for improving anchoring strength without requiring an undue number of components for increasing anchoring strength.

SUMMARY OF THE INVENTION

The present disclosure generally involves an autonomous anchor device, comprising: a streamlined body configured to freefall through a water column and to drive itself into sediment of an aquatic environment; and a plurality of blades operably coupled with the streamlined body and configured to deploy itself into the sediment.

BRIEF DESCRIPTION OF THE DRAWINGS

The above, and other, aspects and features of several embodiments of the present disclosure will be more apparent from the following Detailed Description of the Invention as presented in conjunction with the following several figures of the Drawings.

Figure 1:
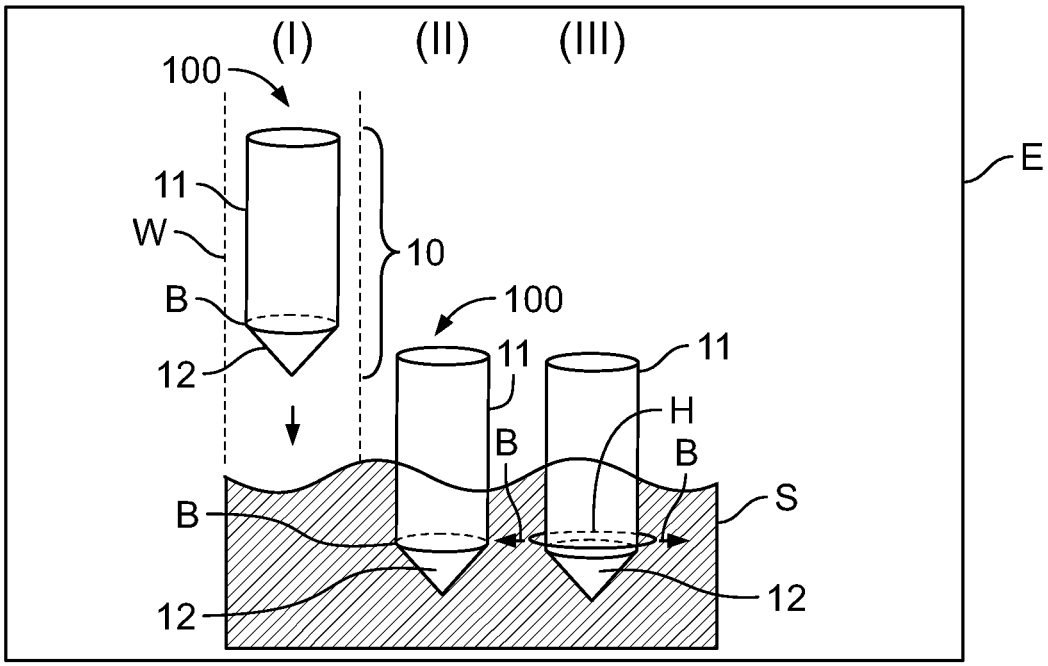
FIG. 1 is a diagram illustrating an autonomous anchor device, in accordance with an embodiment of the present disclosure.

Corresponding reference numerals or characters indicate corresponding components throughout the several figures of the Drawings. Elements in the several figures are illustrated for simplicity and clarity and have not necessarily been drawn to scale. For example, the dimensions of some of the elements in the figures may be emphasized relative to other elements for facilitating understanding of the various presently disclosed embodiments. Also, common, but well-understood, elements that are useful or necessary in commercially feasible embodiments are often not depicted in order to facilitate a less obstructed view of these various embodiments of the present disclosure.

DETAILED DESCRIPTION OF THE INVENTION

In order to address many of the related art challenges, the present disclosure generally involves an autonomous anchor device comprising a high anchoring strength, e.g., in a range of up to approximately seventy percent (70%) greater anchoring strength than in related art anchoring systems, which is configured to "drop" from a vessel and autonomously anchor itself into an aquatic floor, e.g., an ocean floor, a sea floor, and a lake floor, without the necessity of further components, as otherwise would be required in the related art.

Referring to FIG. 1, this diagram illustrates an autonomous anchor device A, comprising: a streamlined body 10 configured to freefall through a water column W and to drive itself into sediment S of an aquatic environment E; and a plurality of blades B operably coupled with the streamlined body 10 and configured to deploy itself into the sediment S, in accordance with an embodiment of the present disclosure. The streamlined body 10 comprises: an upper body portion 11; and a lower body portion 12 coupled with the upper body portion 11 by one of integral formation and separate formation, whereby the streamlined body 10 is configured to freefall through the water column W and to drive itself into the sediment S of the aquatic environment E. The upper body portion 11 comprises at least one of: a rigid material, a constant cross-section, and a cylindrical shape; and the lower body portion 12 comprises at least one of: a rigid material, a decreasing cross-section, and a conical shape. By example only, the upper body portion 11 comprises a generally cylindrical shape; and the lower body portion 12 comprises a generally conical shape. However, the streamlined body portion 10 may comprise any configuration suitable for a particular implementation. The streamlined body 10 further comprises a sufficient potential energy, as a function of its geometry and characteristics of the sediment, prior to "dropping anchor" for providing a sufficient kinetic energy upon, and during, "dropping anchor," as indicated by Phase I of operation, for facilitating its self-driving into the sediment S, as indicated by Phase II of operation.

Still referring to FIG. 1, the plurality of blades B is configured to deploy into the sediment S, e.g., in a generally horizontal plane H, in at least one mode, such as by command and by time delay, as indicated by Phase III of operation, whereby the autonomous anchor device A acquires enhanced anchoring strength via at least impact-burial and blade-deployment in the horizontal plane H in the sediment S. The plurality of blades B is deployable by using any actuation structure as an actuator, such as at least one motor, at least one pneumatic device, at least one spring, at least one lever, and any other actuation component. For example, the plurality of blades B is deployable in a command mode by electronics and in a time-delay mode by natural forces. Detailed examples of actuation techniques for blade-deployment include, but are not limited to, electronics, such as used in conjunction with timers and acoustic signals as well as natural forces, such as water pressure, microbial action, tidal shifts, currents, moon phases, and aquatic life-form interactions, e.g., fish bites.

Still referring to FIG. 1, by impact burial and blade-deployment, the autonomous anchor device A maintains an increased surface area under the sediment S, whereby shear strength of surrounding undisturbed portions of the sediment S maintains disposition of the autonomous anchor device A, rather than merely relying on shear strength at an interface between an anchor's surface and a disturbed portion of the sediment S, as otherwise relied in the related art. Additionally, by impact burial and blade-deployment, the autonomous anchor device A maintains an increased suction area over that in the related art. Finally, by impact burial and blade-deployment, the autonomous anchor device A, having an increased circumference corresponding to an increased cross-sectional area in relation to a shear area, maintains an increased pullout area over that in the related art. These foregoing features are achieved by the autonomous anchor device A without reducing the burial depth, as otherwise would be the circumstance if the plurality of blades B is deployed prior to impact with, or embedment in, the sediment S.

Figure 2:
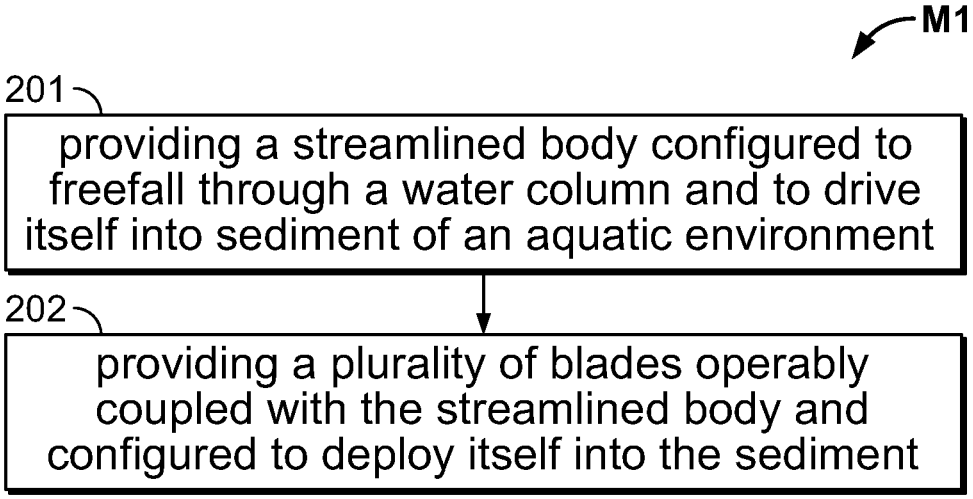
FIG. 2 is a diagram illustrating a method of fabricating an autonomous anchor device, in accordance with an embodiment of the present disclosure.

Referring to FIG. 2, this flow diagram illustrates a method M1 of fabricating an autonomous anchor device A, comprising: providing a streamlined body 10 configured to freefall through a water column W and to drive itself into sediment S of an aquatic environment E, as indicated by block 201; and providing a plurality of blades B operably coupled with the streamlined body 10 and configured to deploy itself into the sediment S, as indicated by block 202, in accordance with an embodiment of the present disclosure. Providing the streamlined body 10, as indicated by block 201, further comprises providing the streamlined body 10 with a sufficient potential energy, as a function of its geometry and characteristics of the sediment, prior to "dropping anchor" for providing a sufficient kinetic energy upon, and during, "dropping anchor," as indicated by Phase I of operation, for facilitating its self-driving into the sediment S, as indicated by Phase II of operation. Providing the plurality of blades B, as indicated by block 202, comprises configuring the plurality of blades B to deploy into the sediment S, e.g., in a generally horizontal plane H, in at least one mode, such as by command and by time delay, as indicated by Phase III of operation, whereby the autonomous anchor device A acquires enhanced anchoring strength via at least impact-burial and blade-deployment in the horizontal plane H in the sediment S.

Still referring to FIG. 2, providing the plurality of blades B, as indicated by block 202, comprises providing the plurality of blades B as deployable by using any actuation structure, such as at least one of: at least one motor, at least one pneumatic device, at least one spring, at least one lever, and any other actuation component. For example, providing the plurality of blades B, as indicated by block 202, comprises providing the plurality of blades B as deployable in a command mode by electronics and in a time-delay mode by natural forces. Detailed examples of actuation techniques for blade-deployment include, but are not limited to, electronics, such as used in conjunction with timers and acoustic signals as well as natural forces, such as water pressure, microbial action, tidal shifts, currents, moon phases, and aquatic life-form interactions, e.g., fish bites.

Figure 3:
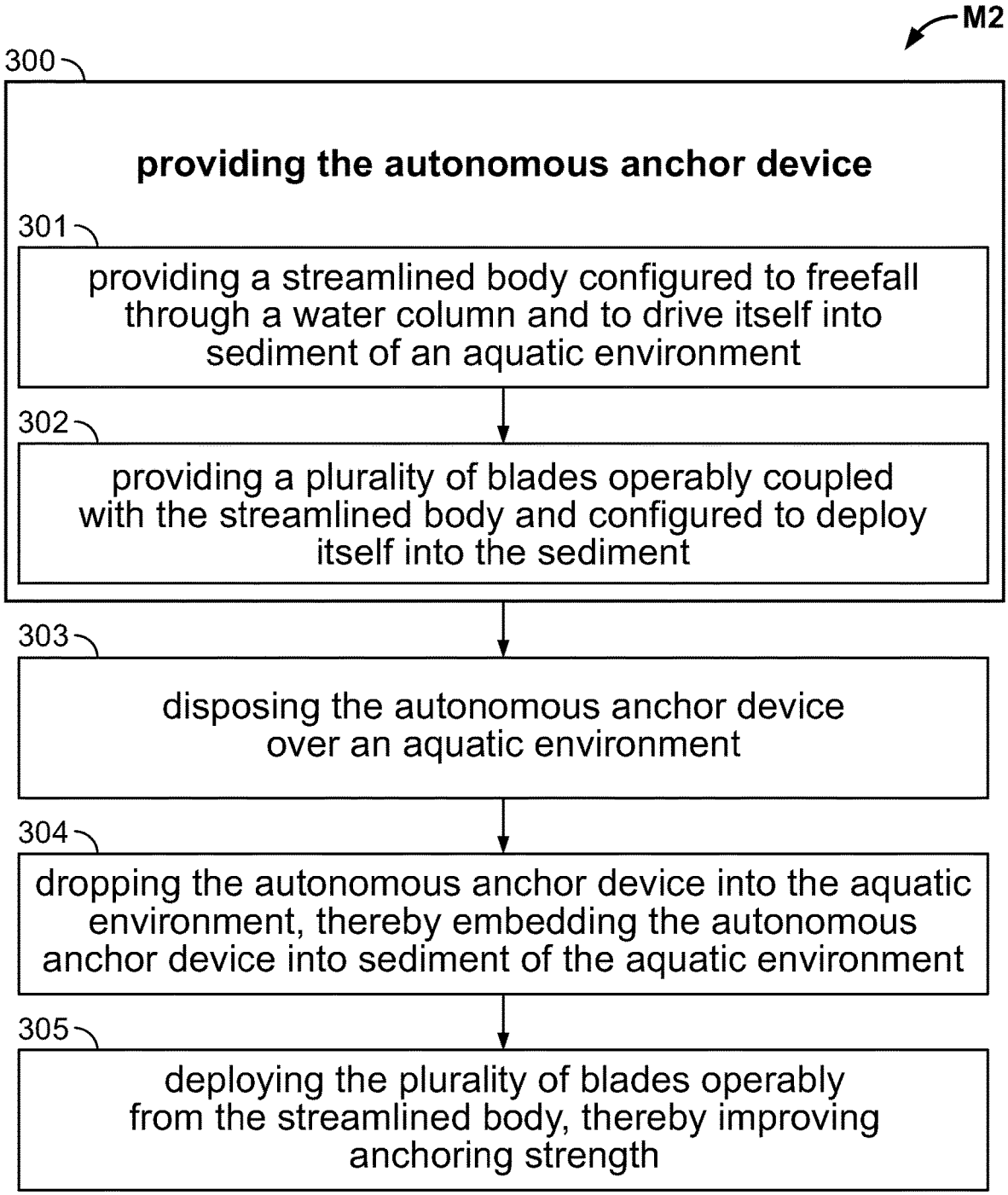
FIG. 3 is a diagram illustrating a method of anchoring a vessel by way of an autonomous anchor device, in accordance with an embodiment of the present disclosure.

Referring to FIG. 3, this flow diagram illustrates a method M2 of anchoring a vessel by way of an autonomous anchor device A, comprising: providing the autonomous anchor device A, as indicated by block 300, providing the autonomous anchor device A comprising: providing a streamlined body 10 configured to freefall through a water column W and to drive itself into sediment S of an aquatic environment E, as indicated by block 301; and providing a plurality of blades B operably coupled with the streamlined body 10 and configured to deploy itself into the sediment S, as indicated by block 302; disposing the autonomous anchor device over an aquatic environment, as indicated by block 303; dropping the autonomous anchor device into the aquatic environment, thereby embedding the autonomous anchor device into sediment of the aquatic environment, as indicated by block 304; and deploying the plurality of blades operably from the streamlined body, thereby improving anchoring strength, as indicated by block 305, in accordance with an embodiment of the present disclosure.

Still referring to FIG. 3, in the method M2, providing the streamlined body 10, as indicated by block 301, further comprises providing the streamlined body 10 with a sufficient potential energy, as a function of its geometry and characteristics of the sediment, prior to "dropping anchor" for providing a sufficient kinetic energy upon, and during, "dropping anchor," as indicated by Phase I of operation, for facilitating its self-driving into the sediment S, as indicated by Phase II of operation. Providing the plurality of blades B, as indicated by block 302, comprises configuring the plurality of blades B to deploy into the sediment S, e.g., in a generally horizontal plane H, in at least one mode, such as by command and by time delay, as indicated by Phase III of operation, whereby the autonomous anchor device A acquires enhanced anchoring strength via at least impact-burial and blade-deployment in the horizontal plane H in the sediment S. Providing the plurality of blades B, as indicated by block 202, comprises providing the plurality of blades B as deployable by using any actuation structure, such as at least one motor, at least one pneumatic device, at least one spring, at least one lever, and any other actuation component. For example, providing the plurality of blades B, as indicated by block 202, comprises providing the plurality of blades B as deployable in a command mode by electronics and in a time-delay mode by natural forces. Detailed examples of actuation techniques for blade-deployment include, but are not limited to, electronics, such as used in conjunction with timers and acoustic signals as well as natural forces, such as water pressure, microbial action, tidal shifts, currents, moon phases, and aquatic life-form interactions, e.g., fish bites.

Referring back to FIGS. 1-3, other features of the autonomous anchor device A include, but are not limited to, an increasing anchoring strength of an impact buried body, eliminating related art complexities for setting an anchor, providing autonomy for setting an anchor, consuming less power than related art anchoring systems, improving anchoring performance in muddy aquatic environments as well as sandy aquatic environments, and retracting the plurality of blades B, e.g., on command, for facilitating and accelerating un-anchoring.

Referring back to FIGS. 1-3, alternative features of the autonomous anchor device A include, but are not limited to, further actuation structures for deploying the plurality of blades B, such as a mechanism for folding the plurality of blades B and a mechanism for pivoting the plurality of blades B. The autonomous anchor device A may be alternatively used in non-marine environments. Also, spikes, protrusions, and other geometrical variations could be used instead of the plurality of blades B and are encompassed by the present disclosure. Further, shape, size, and location of any protruding structures may vary along, or around, the streamlined body 10.

Understood is that many additional changes in the details, materials, steps and arrangement of parts, which have been herein described and illustrated to explain the nature of the invention, may be made by those skilled in the art within the principle and scope of the invention as expressed in the appended claims.

What is claimed:

1. A method of anchoring by way of an autonomous anchor device, comprising:

allowing an anchor with a streamlined body and a lower end to freefall through a water column, lower-end-first, until impacting an aquatic floor such that upon impact, the lower end is driven vertically into, and buried in, sediment of the aquatic floor;

using electronics comprising an anode and a cathode mounted to the anchor to detect microbial action in the sediment;

upon detecting microbial action in the sediment, deploying blades horizontally from the buried lower end into the sediment thereby increasing the anchor's buried surface area, wherein the deploying step is triggered by microbial action.

2. The method of claim 1, wherein a motor is used to deploy the blades.

* * * * *